United States Patent [19]

Nakasuji et al.

[11] Patent Number: 5,004,143

[45] Date of Patent: Apr. 2, 1991

[54] METHOD OF MANUFACTURING CLAD BAR

[75] Inventors: Kazuyuki Nakasuji; Chihiro Hayashi, both of Amagasaki, Japan

[73] Assignee: Sumitomo Metal Industries, Ltd., Osaka, Japan

[21] Appl. No.: 79,143

[22] Filed: Jul. 28, 1987

[30] Foreign Application Priority Data

| | | | |
|---|---|---|---|
| Jul. 31, 1986 | [JP] | Japan | 61-181635 |
| Aug. 8, 1986 | [JP] | Japan | 61-187318 |
| Nov. 14, 1986 | [JP] | Japan | 61-272580 |

[51] Int. Cl.[5] ..... B23K 20/04

[52] U.S. Cl. ..... 228/126; 228/131; 228/132; 228/235; 228/265

[58] Field of Search ..... 228/126, 127, 131, 133, 228/265, 17, 158, 263.21, 235, 132; 72/47, 200, 224, 700

[56] References Cited

U.S. PATENT DOCUMENTS

| | | | |
|---|---|---|---|
| 2,947,078 | 8/1960 | Pflumm et al. | 228/127 |
| 3,462,828 | 8/1969 | Winter | 278/235 |
| 3,463,620 | 8/1969 | Winter | 228/131 |
| 4,162,758 | 7/1979 | Mikarai | 228/158 |
| 4,512,177 | 4/1985 | Hayashi et al. | 72/368 |
| 4,612,259 | 9/1986 | Ueda | 228/158 |

FOREIGN PATENT DOCUMENTS

| | | | |
|---|---|---|---|
| 0145803 | 6/1985 | European Pat. Off. | 228/131 |
| 1281813 | 10/1968 | Fed. Rep. of Germany | 228/107 |
| 2517839 | 6/1975 | Fed. Rep. of Germany | 228/127 |
| 54-8188 | 4/1979 | Japan . | |
| 54-160551 | 12/1979 | Japan . | |
| 55-141313 | 11/1980 | Japan . | |
| 58-103928 | 6/1983 | Japan . | |
| 167073 | 10/1983 | Japan | 228/263.21 |
| 59-110486 | 6/1984 | Japan . | |
| 116342 | 7/1984 | Japan | 228/263.21 |
| 61-42416 | 2/1986 | Japan . | |
| 1073889 | 4/1986 | Japan | 228/127 |
| 677851 | 8/1979 | U.S.S.R. | 228/131 |

OTHER PUBLICATIONS

Zernow et al., "Explosive Welding . . . ", ASTME Paper No. SP60-141, copyright 1961.

Cranston et al., "Small Area, High Energy Bonding", The Western Electric Engineer, pp. 26-35, Oct., 1978.

Pearson et al., "Research in Explosive Welding", Michelson Laboratory, U.S. Naval Station, China Lake, Calif., 1961.

*Primary Examiner*—Sam Heinrich

*Attorney, Agent, or Firm*—Burns, Doane, Swecker & Mathis

[57] ABSTRACT

The present invention relates to a method of manufacturing a clad bar and is basically characterized in that a columnar core member is fitted in a cylindrical outside layer member and the resulting assembly is heated, and then the heated assembly is rolled by a rotary mill provided with three or more cone type rolls to integrate the core member and the outside layer member by diffusion bending. The method is additionally characterized in that, in order to prevent unnecessary substances, such as oxides, from being formed on an interface between the core member and the outside layer member, the assembly is sealed at both ends thereof under reduced pressure or under vacuum or the assembly is cold drawn, the assembly thus welded or cold drawn is then heated and subsequently rolled by a rotary mill. Thus, an intermetallic compound layer formed between the core member and the outside layer member can be thinned, whereby improving bond strength.

30 Claims, 15 Drawing Sheets

METHOD OF MANUFACTURING CLAD BAR

BACKGROUND OF THE INVENTION

1. Field of the Invention

The present invention relates to a method of manufacturing a clad bar comprising an inner layer of one metal and an outer layer formed of another metal.

2. Description of the Prior Art

A clad bar comprising a core member and an outer layer member coated on an outside of said core member to utilize mechanical properties of the core member and a corrosion-resistance, abrasion-resistance and beautiful external appearance of the outer layer member has been known. The following methods of manufacturing a clad bar have been known.

<1> Japanese Patent Laid-Open No. 141313/1980

This relates to a method in which a core member is fitted in a cylindrical outer layer member, the resulting assembly being subjected to a cold drawing to closely contact the outer layer member to the core member, and then the cold drawn assembly being heated followed by rolling by grooved rolls. With this method, a brittle layer of intermetallic compounds is formed at the bonding interface between the core member and the outer layer member, whereby the sufficient bond strength cannot be attained.

<2> Japanese Patent Laid-Open No. 160551/1979

This relates to a method in which a core member is fitted in a cylindrical outer layer member, the resulting assembly being subjected to a cold drawing, and then annealed to bring about the diffusion through the boundary surface, whereby carrying out the bond. With this method, since intermetallic compounds formed by the diffusion are brittle and weak, the bond strength is reduced.

<3> Japanese Patent Laid-Open No. 110486/1984

This relates to a method in which a core member is fitted in a cylindrical outer member, the resulting assembly being subjected to a cold reduction, a disk formed of the same material as the outer layer member being welded to both end faces of the reduced assembly by the friction welding to seal up a gap between the core member and the outer layer member, and then the assembly being heated followed by being subjected to a hot rolling by grooved rolls or hot extrusion.

With this method, the rolling is alternately carried out in a direction different 90° to each other in the hot rolling by the grooved rolls, so that a portion subjected to the compression in one rolling receives a tensile force in a radial direction in the subsequent rolling, whereby bringing out the separation of the outer layer member from the core member at the bonding interface therebetween. In addition, the hot extrusion does not lead to the attainment of the sufficient bond strength.

<4> Japanese Patent Laid-Open No. 103928/1983

This relates to a method in which a core member is fitted in a cylindrical outer layer member, and then merely the outer layer member is reduced by means of a die so that the core member may not be deformed. With this method, since a heating is not applied, a diffusion layer is not formed in the bonding interface between the core member and the outer layer member, that is, the core member and the outer layer member are not integrated with each other. As a result, the bond strength is reduced.

<5> Japanese Patent Publication No. 8188/1979

This relates to a method in which a core member is fitted in an outer layer member, and then both members are simultaneously elongated by the hydrostatic extrusion method to carry out the bond. With this method, not only the bond strength is not sufficient, but also a length of a product capable of manufacturing has an upper limit since it is necessary to increase an elongation rate in the event that a long product is manufactured. In addition, this method is complicated in comparison with the methods <1> to <4>.

Besides, in a rolling method using a grooved roll as in the methods <1> and <3>, a sectional shape of the core member after rolling becomes quite different from a circular shape, so that a thickness of the outer layer member becomes uneven. Accordingly, disadvantages occur in the exposure of the core member in the subsequent turning process and the like.

As described above, with the conventional methods, no sufficient bond strength has been attained. Accordingly, the development of a method of manufacturing a clad bar, to which a superior bond strength is required, has been expected.

SUMMARY OF THE INVENTION

A first object of this invention is to provide a method of manufacturing a clad bar capable of attaining a high bond strength by carrying out hot rolling using a rotary mill having three or more cone-type rolls.

A second object of this invention is to provide a method of manufacturing a clad bar capable of attaining the still higher bond strength by sealing the gap between a core member and an outer layer member under reduced pressure or vacuum in order to prevent oxidation in a bonding interface resulting from heating.

A third object of this invention is to provide a method of manufacturing a clad bar capable of preventing oxidation in the bonding interface when heated even where the coefficient of thermal expansion of the outer layer member is larger than that of the core member.

A forth object of this invention is to provide a method of manufacturing a clad bar capable of attaining the still higher bond strength by carrying out cold drawing prior to heating to eliminate a gap between an outer layer member and a core member.

A fifth object of this invention is to provide a method of manufacturing a clad bar capable of making a uniform thickness of an outer layer member.

The purport of the present invention consists in that an assembly comprising a core member and an outer layer member fitted about said core member is heated, and then subjected to a rolling by a rotary mill having three or more cone type rolls to bond both members to each other.

In order to make the hot rolling progress smooth, both members are fixed at an end of the assembly and in order to prevent oxidation in the bonding interface when heated, the gap between both members of the assembly is sealed up under reduced pressure or under vacuum. When the coefficient of thermal expansion of the outer layer member is greater than that of the core member, this sealing up process is indispensable.

In addition, in order to attain the superior bond strength, a cold drawing is carried out prior to the hot rolling so as to eliminate the gap between the outer layer member and the core member.

The above and further objects and features of the invention will more fully be apparent from the following detailed description with accompanying drawings.

DESCRIPTION OF THE PREFERRED EMBODIMENTS

The present invention is fundamentally characterized in that an assembly is elongated in a rotary mill having three or more cone type rolls after heating. The first preferred embodiment, which will be below described, comprises merely these fundamental characteristics, in short, this first preferred embodiment comprises a process in which a core member is fitted in an outer layer member and then the resulting assembly is elongated after heating.

Figure 1:
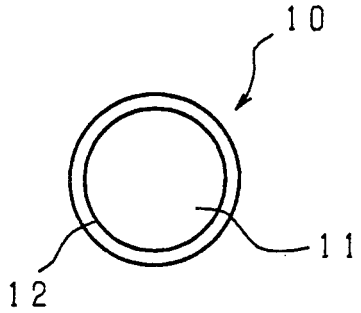
FIG. 1 is a sectional view showing an assembly.
Figure 2:
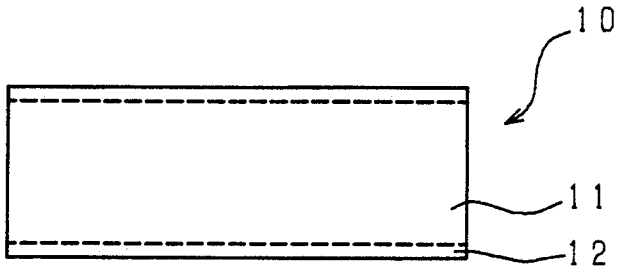
FIG. 2 is a side view showing the assembly.

As shown in FIGS. 1 and 2, an assembly 10 is round rod-like and comprises a cylindrical outer layer member 12 put on a periphery of a core member 11 having a circular cross-section. This assembly is heated in a heating furnace (not shown) and then transferred in a rotary mill which permits high reduction.

Figure 3:
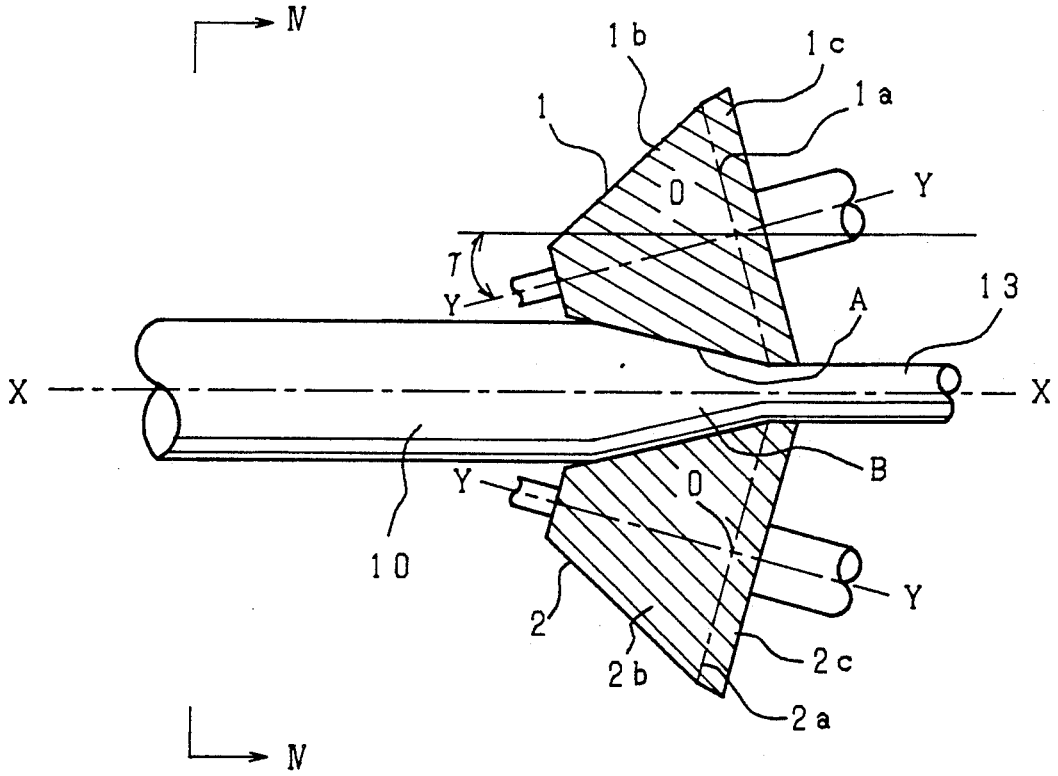
FIG. 3 is a schematic side view showing a rotary mill used in a method according to the present invention.
Figure 4:
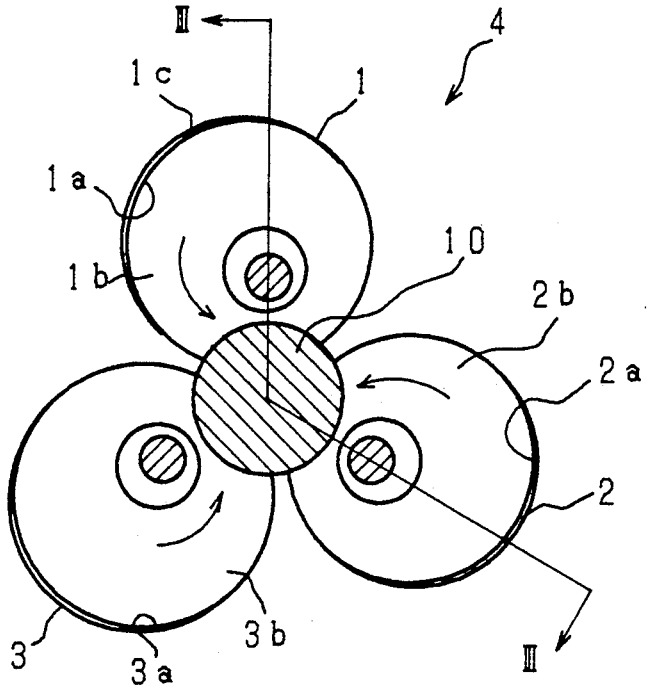
FIG. 4 is a sectional view of FIG. 3 taken along a line IV—IV thereof.

FIG. 3 shows the principal parts of a rotary mill 4 used in the present invention, rolls 1 and 2 being shown in a sectional view taken along a line III—III of FIG. 4. The rotary mill 4 has three cone type rolls 1, 2, 3 arranged around a pass line, said three rolls 1, 2, 3 being provided with gorged portions 1*a*, 2*a*, 3*a*, respectively, at an outlet side (larger roll diameter side) end portion of the assembly 10, an inlet side (smaller roll diameter side) of the assembly 10 forming inlet faces 1*b*, 2*b*, 3*b* having a diameter gradually reduced toward an axial end with the gorged portions as boundaries, an outlet side of the assembly 10 forming outlet faces 1*c*, 2*c*, 3*c* having an inclination smaller than that of the inlet faces 1*b*, 2*b*, 3*b*, and a distance between the outlet faces 1*c*, 2*c*, 3*c* and the pass line being made equal to that between the gorged portions 1*a*, 2*a*, 3*a* and the pass line.

Figure 5:
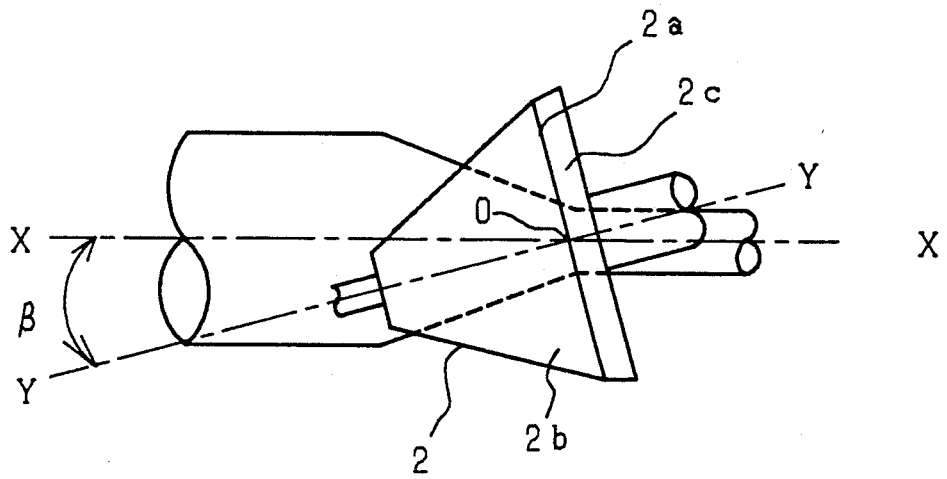
FIG. 5 is a rough side view showing a feed angle $\beta$.

Such cone type rolls 1, 2, 3 are all arranged so that the inlet faces 1*b*, 2*b*, 3*b* thereof may be positioned in an upstream side of a transfer direction of the assembly 10 and intersecting point O (hereinafter referred to as a roll-arranging center) of an axis shaft line Y—Y and planes including the gorged portions 1*a*, 2*a*, 3*a* may be positioned around the pass line X—X at regular intervals on the same one plane meeting at right angles with the pass line X—X of the assembly 10. And, the axis shaft line Y—Y of each roll 1, 2, 3 is inclined by a cross angle of $\gamma$ around the roll-arranging center so that a forward axial end may approach toward the pass line X—X, as shown in FIG. 3, and said forward axial end is inclined by a feed angle of $\beta$ toward the same one side of a circumferential direction of the assembly 10, as shown in FIGS. 4, 5. The rolls, 1, 2, 3 are connected with a driving device (not shown) and are rotated in the same one direction, as shown by an arrow in FIG. 4. The hot assembly 10 is threaded between the rolls and moved forward in the axial direction while being rotated on its axis, that is, it is forced to make a spiral progressive movement.

The assembly 10 is reduced in outside diameter by a bite portion A of the roll under such high reduction as a reduction in area of 25% or more but at most 80 to 90% while it is forced to make the spiral progressive movement among the rolls so that an outside surface B of rolling portion of the assembly 10 may be formed in a frusto-conical shape, as shown in FIG. 3, and then turned into a round clad bar 13 having an appointed outside diameter in the gorged portion and the outlet face. This rolling is not limited to one pass. Two or more passes may be carried out.

A method of the present invention will be below described more concretely.

The assembly 10 is formed by degreasing and cleaning an outside surface of a core member 11 having a circular section and an inside surface of a cylindrical outside layer member 12 having an inside diameter nearly equal to an outside diameter of the core member 11 to remove oils and the like hindering diffusion the core member 11 is then fitted or inserted in the outside layer member 12 with an interface between the two members. The outside layer member 12 is preferably made of a material having a deformation resistance larger than that of the core member 11, if possible.

Subsequently, the assembly 10 is heated to form a diffusion layer on the above described interface, whereby bonding the outside surface of the core member 11 to the inside surface of the outside layer member 12. A heating temperature is selected which is lower than the melting points of the core member 11, the outside layer member 12 and intermetallic compounds thereof because if even one of the core member 11 and the outside layer member 12 is molten, its solidification leads to the generation of cracks which reduce the bond strength. In addition, this heating temperature is selected in view of a quantity of heat generated during the rolling under high reduction.

The assembly 10, which was heated in this manner, is elongated by means of a rotary mill 4.

The rolling conditions by the rotary mill 4 are selected depending upon the diameter, deformation resistance and the like of the assembly 10 but the cross angle $\gamma$ is selected at 0°-15° and the feed angle $\beta$ is selected at 6°-20°.

Next, the facilities used and operating conditions are described below.

The rotary mill 4 is used because the bond strength, which has been wanting in the conventional grooved rolling, is increased. In grooved rolling, a plurality of pairs of grooved rolls having a pressing direction different 90° to each other are provided along the pass line, so that in the rolling by means of a pair of grooved rolls, the assembly 10 exhibits portions restricted by the rolls and portions which are not restricted by the rolls.

Provided that in the portions which are not restricted by the rolls the strain of the core member 11 in the direction of elongation due to the rolling is $\epsilon_{z1}$, the strain of the core member 11 in a direction vertical to the direction of elongation (in the radial direction) due to rolling is $\epsilon_{r1}$, the strain of the outside layer member 12 in the direction of elongation due to the rolling is $\epsilon_{z2}$, and the strain of the outside layer member 12 in a direction vertical to the direction of elongation (in the radial direction) due to rolling is $\epsilon_{r2}$. If the core member 11 and the outside layer member 12 are rolled at the same time, $\epsilon_{z1}>\epsilon_{z2}$ holds good in the event that the core member 11 is smaller than the outside layer member 12 in deformation resistance.

However, since the volume is constant even though the deformation occurs by the rolling, the following equation hold good.

$$\epsilon_{z1}+\epsilon_{o1}+\epsilon_{r1}=0$$

whereby $\epsilon_{o1}$ represents a strain in a peripheral direction of the core member; and $$\epsilon_{z2}+\epsilon_{o2}+\epsilon_{r2}=0$$

whereby $\epsilon_{o2}$ represents a strain in a peripheral direction of the outside layer member.

Provided that $\epsilon_{o1}\approx\epsilon_{o2}$, $\epsilon_{r1}<\epsilon_{r2}$ holds good. That is, the strain of the outside layer member 12 in the direction vertical to the direction of elongation (in the radial direction) becomes larger than that of the core member 11, thereby generating a radial tensile stress on an interface between the outside layer member 12 and the core member 11. In short, a portion compressed in the rolling by means of a certain pair of grooved roll becomes a non-restricted portion in the rolling by means of a next pair of grooved rolls different 90° in pressing direction to receive the above described tensile stress, so that the separation of the layers is apt to be generated.

Figure 7:
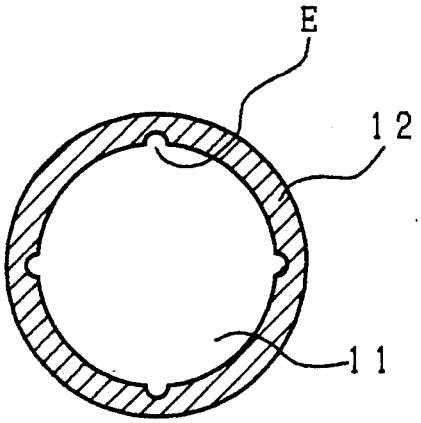
FIG. 7 is a sectional view showing a clad bar manufactured by rolling using a grooved roll.

In addition, a cross section of the clad bar subjected to the grooved rolling is formed of four projections E arranged at regular intervals in a peripheral direction of the core member 11 and a wall-thickness of the outside layer member 12 is reduced at such four portions, that is, it becomes uneven, as shown in FIG. 7.

Figure 6:
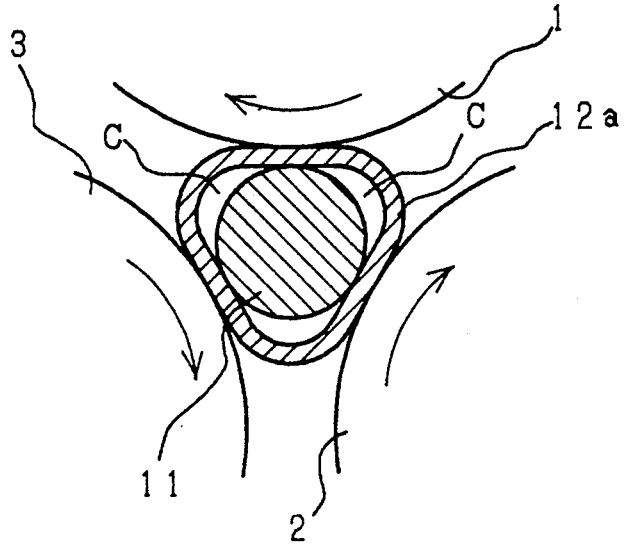
FIG. 6 is a schematic diagram showing a state of generating the flaring.

On the contrary, in the case where the rotary mill is used, as obvious from FIGS. 3, 4, 6, the restricted portions and the non-restricted portions are formed on the same one peripheral portions of the assembly but the assembly makes a spiral progress among the rolls, so that the tensile stress is not acted upon the portions which receive the compression pressure.

Accordingly, in the case where the rotary mill is used, the tensile stress, which is generated in the above described grooved rolling, is not generated. This is advantageous to the bond of the boundary interface. In addition, in the case where the rotary mill is used, a maximum reduction in area of 80-90% per pass can be attained. And, as a result, a working heat is generated in the assembly 10 heated at the above described low temperature to promote the diffusion. Besides, even though the intermetallic compounds are formed, the thickness of the formed intermetallic compound layer can be reduced by rolling under high reduction, whereby producing a clad bar 13 superior in bond strength.

Furthermore, internal cracks due to the so-called "Mannesmann effect", which are generated in the central portion of a rod rolled when an rotary mill having two rolls is used, can be prevented from being generated when a rotary mill having three or more rolls is used.

The above described rolls have a structure supported at both ends. This is because such a structure can lead to an accuracy of size of outside diameter within ±0.1% but a structure supported at one-end leads to the deterioration of dimensional accuracy of outside diameter to ±0.7% on account of the decrease of mill rigidity and an influence of slip along the interface between both metals of an assembly to be rolled. Accordingly, the structure supported at both ends is preferably used.

Next, a cross angle $\gamma$ is described.

U.S. Pat. No. 4,512,177, British patent application No. 83-17789, Canadian patent application No. 431,444 and Australian patent application No. 16285/83 relate to a method of manufacturing a bar in high efficiency without generating internal cracks, in which a cross type rotary mill having three or more rolls is used. According to the inventions of this patent and these patent applications, a dimensional accuracy of outside diameter is dependent upon a cross angle $\gamma$.

In the case of $\gamma>0°$, the accuracy is ±0.05 to ±0.1%.

In the case of $\gamma=0°$, the accuracy is ±0.17%.

In the case of $\gamma<0°$, the accuracy is ±0.4% to ±0.75%.

A similar tendency appears also in the rolling process of the present invention but in the case of a clad bar, the degree of change in outside diameter becomes the degree of change in thickness of an outside layer member, so that it is necessary to suppress this degree of change in outside diameter as far as possible in the case where the outside layer member is thin, in the case where the outside layer member is machined by turning in the subsequent process, and the like. Otherwise, the core member could be exposed.

Accordingly, $\gamma \geqq 0°$ is selected in the case where the outside layer is thin, in the case where the outside layer member is machined by turning in the subsequent process, and the like.

On the other hand, an upper limit of $\gamma$ is 15° in view of a limit of a design of chocks holding a roll shaft in a structure supported at both ends.

Next, a feed angle $\beta$ is described.

A rolling speed v is calculated by the following equation:

$$v = \pi D \times (N/60) \times \sin\beta \times \eta (m/s)$$

wherein

D: a diameter of gorged portions (m)

N: a rotational frequency of roll (rpm)

$\eta$: advancing factor (0.7 to 1.5 depending upon the surface condition of a roll and the like)

In view of the oscillation of a rod to be rolled, an upper limit of rotational frequency of a roll is 250 rpm.

It is required for attainment of a certain extent of rolling speed to maintain a feed angle $\beta$ at a certain magnitude. A lower limit of the feed angle $\beta$ is 6°.

On the other hand, a length of a portion, on which the rod to be rolled is brought into contact with the roll, is reduced with an increase of the feed angle $\beta$ and a quantity of the reduced diameter in the spiral movement direction of the rod to be rolled is increased, whereby a slipping phenomenon appears on the interface between both metals of the rod (assembly) to be rolled. If the feed angle becomes 20° or more, the dimensional accuracy of outside diameter becomes ±0.4% or more. Accordingly, the upper limit of $\beta$ is preferably selected at 20°.

Next, a reason why the reduction in area is preferably selected at 25% or more is described.

In order to obtain a sufficient bond on the interface between the core member and the outside layer member, a higher reduction in area is preferably selected.

According to Japanese Industrial Standards (JIS) G3604, a shear strength of 10 kgf/mm$^2$ is required for copper (copper alloys) - clad steels.

In the case where the core member is copper and the outside layer member is stainless steel, a shear strength of 19.2 kgf/mm$^2$ is obtained at a reduction in area of 26.5%.

In addition, in the case where the core member is copper and the outside layer member is titanium, a shear strength of 10.0 kgf/mm$^2$ is obtained at a reduction in area of 25%.

A reduction in area of 25% or more is preferably selected on the basis of the above described actual results.

Next, a reason why the outside layer member is preferably larger than the core member in deformation resistance will be described. If a deformation resistance of the outside layer member is smaller than that of the core member, the outside layer member 12*a* is deformed more greatly than the core member 11 to reduce the wall-thickness thereof. Thus, as shown in FIG. 6, a wall-thickness is reduced, and a peripheral length gets longer, whereby the lengthened portion is jutted out to a gap between rolls to generate the flaring. As a result, a gap C is generated between the core member 11 and the outside layer member 12*a*, whereby the diffusion layer of both metals, which have been already formed by heating, is separated. In order to prevent this, the outside layer member is preferably larger than the core member in deformation resistance.

Next, relations among the reduction in area, heating temperature and shear strength of a bonded portion, and the like will be described below with reference to the preferred embodiments.

(First Example)

Core member: outside diameter: 49 mm (accuracy: −0.1 to +0.0 mm) material: pure Al (JIS 1070)

Outside layer member: outside diameter: 55 mm inside diameter: 49 mm (accuracy: 0.0 to +0.1 mm) material: pure Ti (JIS Grade 2)

This core member and outside layer member were produced by machining, degreased and then, cleaned. Subsequently, the core member was fitted in the outside layer member. The resulting assembly was heated at 400° C., 500° C. and 600° C., respectively, for an hour, and the heated assembly was elongated by an rotary mill at a reduction in area of 20%, 30%, 40%, 60% and 80%. In the rotary mill, cross angle ($\gamma$): 5°, feed angle ($\beta$): 13°, diameter of roll: 120 mm, material of roll: SCM440, rotational frequency of roll: 100 rpm.

Figure 8:
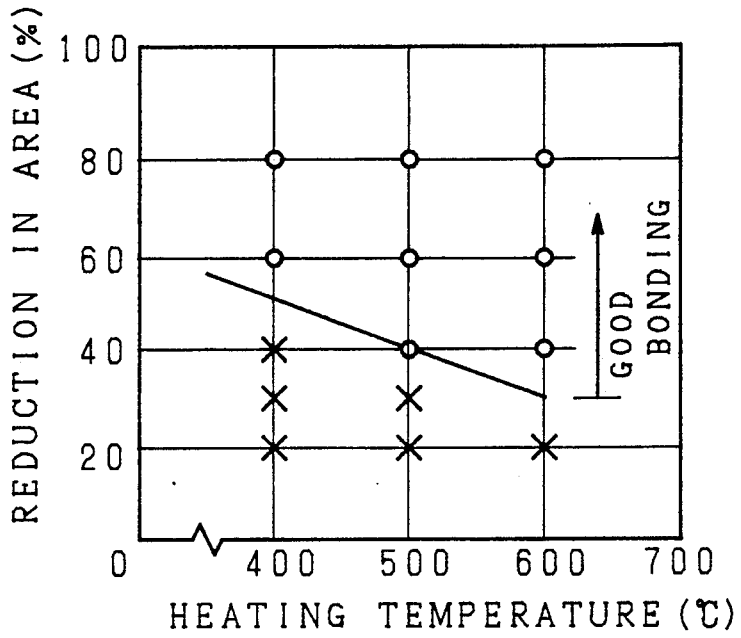
FIG. 8 is a graph showing an appearance of bonding of a clad bar manufactured by a method according to the present invention.

FIG. 8 shows an appearance of bonding between the core member and the outside layer member on a cutting plane after cutting clad bars produced at various heating temperatures and reductions in area by means of a shearing machine. The heating temperature (°C.) is the abscissa and the reduction in area (%) is the ordinate. shows a good appearance while x shows a bad appearance. As understood from FIG. 8, if the reduction in area is 30% or more, a titanium-clad aluminium bar exhibiting a good bond strength can be manufactured.

In addition, the bonding interface was observed by a scanning electron microscope (SEM), an electron probe micro analysis (EPMA) and an ultrasonic test to find no separation, oxide nor defect.

A titanium-clad aluminium bar was manufactured by the grooved rolling process for comparison. The assembly, which was produced in the same manner as above described was heated at 600° C. and then continuously rolled from an outside diameter of 55 mm to that of 30 mm after six passes (an average reduction in area per pass was 18%). The clad bar manufactured by the grooved rolling exhibited a separation of the outside layer member from the core member on the cutting plane after cutting by a shearing machine as visually observed. In addition, the separation was found at several places by observation of a SEM.

(Second Example)

<1> Core member: pure Cu [tough pitch copper (JIS C 1100)] Outsidelayer member: pure Ti (JIS Grade 2)

<2> Core member: pure Cu [tough pitch copper (JIS C 1100)] Outside layer member: Ti-6A1-4V Assemblies were produced from the above described combinations of core member and outside layer member in the same manner as in First Example and heated at 600° C., 700° C. and 800° C., respectively, for an hour. Subsequently, the heated assembly was elongated by means of a rotary mill in the same manner as in First Example. In addition, as for titanium/copper assembly <1>, a part of assembly was reduced in outside diameter by 2 mm by means of a die and then subjected to a hot elongating. That is, two kinds of clad bar comprising the core member and the outside layer member different in material and one kind of clad bar different in manufacturing method, ie., three kinds of clad bar were manufactured. Second Example is different from First Example in addition of the drawing by means of a die.

Figure 9:
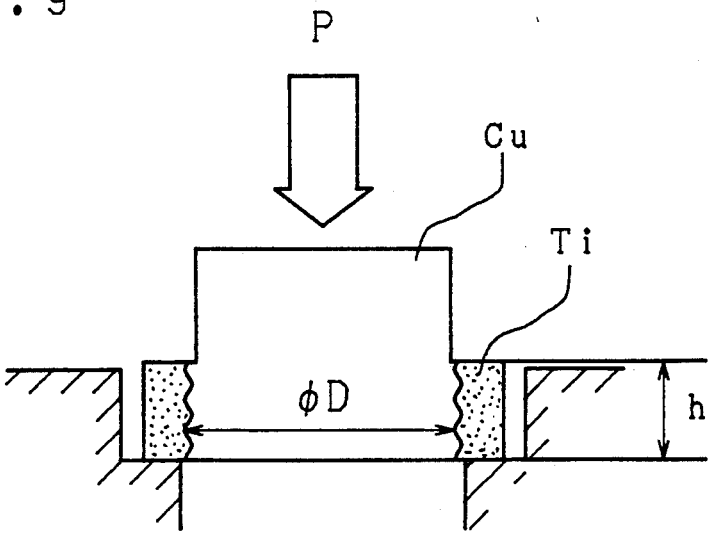
FIG. 9 is a diagram showing a test method of shear strength.

In order to investigate the bond strength of the manufactured clad bar, every two test pieces having a portion of an appointed length h from one end side of a test piece having an appointed length left as it was and the other end side formed in the form of column having an outside diameter smaller than that of the core member, as shown in FIG. 9, were prepared for each clad bar to be investigated. The pressure was given from the other end side under the condition that the outside layer member portion of one end side of the test piece was engaged with an edge portion of a circular opening portion having a diameter slightly larger than an outside diameter of the core member to measure a load P at which the core member and the outside layer member were fractured. The measured value was put in the following equation (2) to obtain a shear strength.

$$\text{Shear strength} = P/(\pi \cdot D \cdot h) \quad (2)$$

wherein D: outside diameter of the core member

Figure 10:
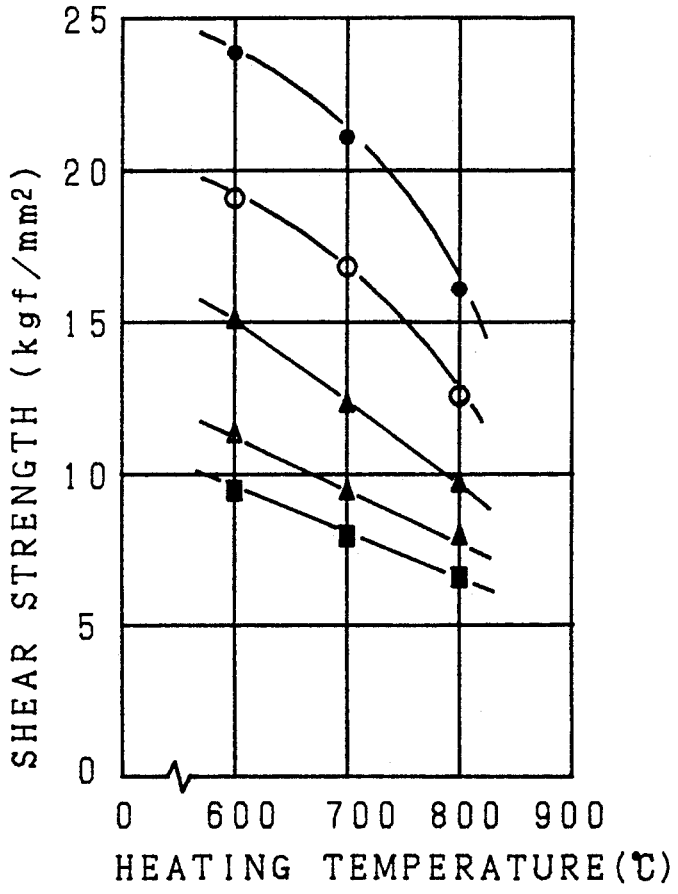
FIG. 10 is a graph showing investigation results of shear strength (a graph showing a relation between a heating temperature and a shear strength of a titanium-clad copper rod)

FIG. 10 collectively shows the investigation results of shear strength of clad bars manufactured at various heating temperatures and reductions in area. The heating temperature (°C.) is the abscissa and the shear strength (kgf/mm$^2$) is the ordinate. As for three kinds of clad bar different in material and manufacturing method clad bars manufactured at the same one heating temperature and reduction in area, they showed a nearly same shear strength, so that an average value was shown for them. Referring to FIG. 10, marks, marks, marks, marks and marks represent a reduction in area of 20%, 30%, 40%, 60% and 80%, respectively. As understood from FIG. 10, it is necessary for attainment of a shear strength of 10 kgf/mm$^2$ to select the reduction in area of 30% or more.

In addition, the bonding interface was observed by a SEM, EPMA and ultrasonic test and no separation, oxide nor defect was found.

Titanium/copper assembly produced in the same manner as in First Example was heated at 800° C. and then subjected to the grooved rolling for comparison. The measured value of shear strength of the manufactured clad bar amounted to 6.5 kgf/mm$^2$ which was lower than the reference value.

Figure 11:
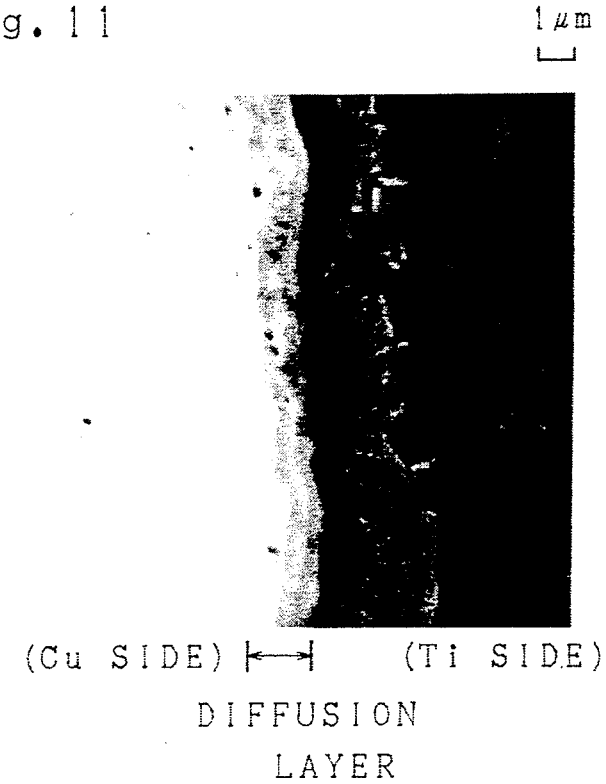
FIG. 11 is a SEM (scanning electron microscope) photograph of a bonding interface between a core member and an outer layer member of a titanium-clad copper rod manufactured by a method according to the present invention.
Figure 12:
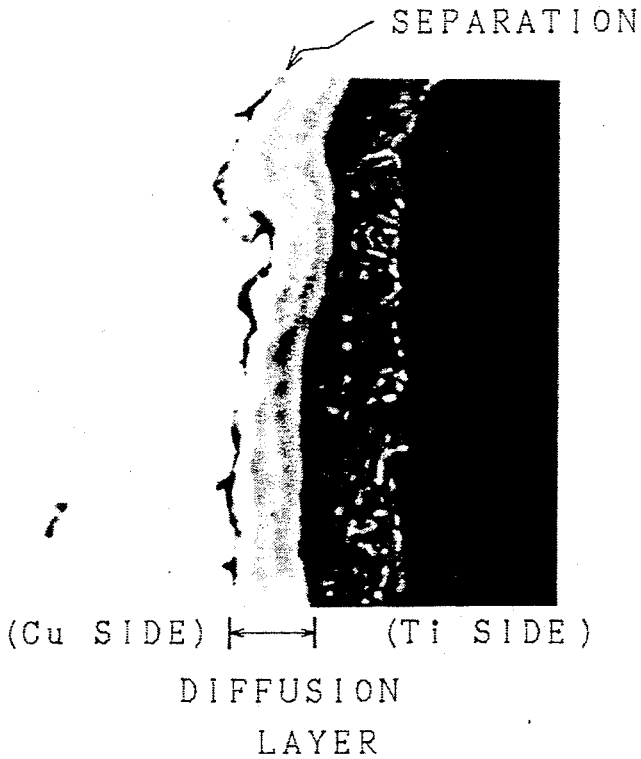
FIG. 12 is a SEM photograph of a bonding interface between a core member and an outer layer member of a titanium-clad copper rod manufactured by means of a grooved roll.

FIG. 11 is a photograph of a bonding interface of a clad bar manufactured according to the present invention at a reduction in area of 80% taken by means of a SEM while FIG. 12 is a photograph of a bonding interface of a clad bar manufactured by the grooved rolling for comparison taken by means of a SEM likewise. As understood from both these photographs, cracks were found on an interface between the diffusion layer and the copper side and the existence of the separation in the clad bar was confirmed in the case of the Comparative Example. On the contrary, no separation was found in the case according to the present invention.

(Third Example)

Core member: pure Cu [tough pitch copper (JIS C 1100)] Outsidelayer member: stainless steel (JIS SUS304)

An assembly comprising the core member and the outside layer member was manufactured in the same manner as in First Example and heated at 900° C., 950° C. and 1,000° C., respectively, for an hour. Then, the heated assembly was elongated by means of a rotary mill in the same manner as in First Example. In addition, a part of the manufactured assemblies was drawn by means of a die in outside diameter by 2 mm and then elongated in the same manner as above described. And, every two test pieces as shown in FIG. 9 were prepared from each of the manufactured clad bars and measured on the shear strength.

Figure 13:
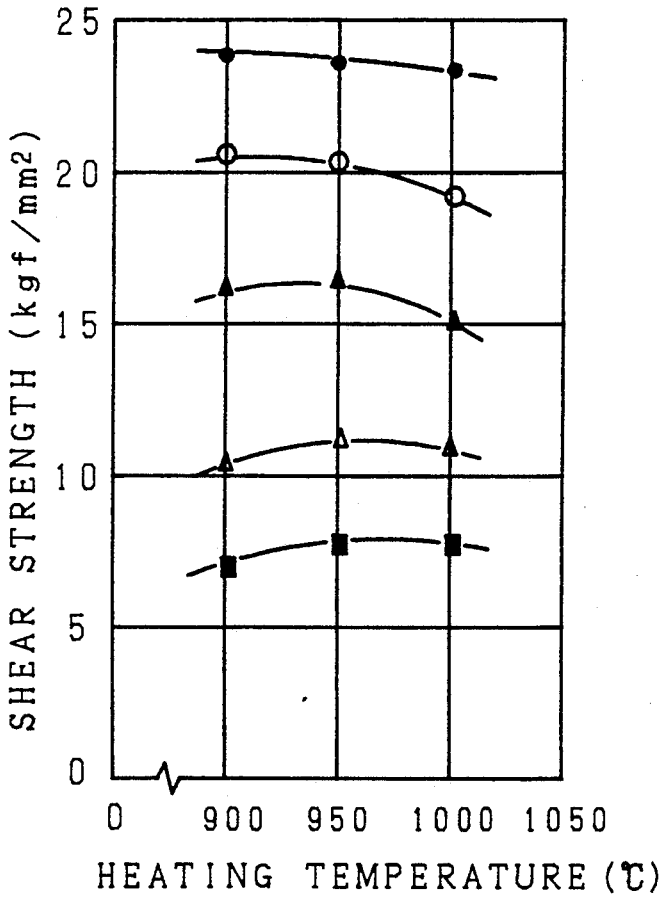
FIG. 13 is a graph showing a relation between a heating temperature and a shear strength of a stainless steel-clad copper rod.

FIG. 13 is a graph collectively showing the measurement results of shear strength of the clad bars manufactured at various heating temperatures and reductions in area. The heating temperature (°C.) is the abscissa and the shear strength (kgf/mm$^2$) is the ordinate. As for two kinds of clad bar different in manufacturing method composite bodies manufactured by the same heating temperature and reduction in area, they showed a nearly same value of shear strength, so that an average value was shown for them. Marks in FIG. 13 represent the same reductions in area as in Example 2. As understood from FIG. 13, if 10 kgf/mm$^2$ is used as a minimum reference of shear strength similarly as in Example 2, the shear strength of the reference value or more can be obtained by selecting the reduction in area at 30% or more. The satisfactory shear strength, in short, the satisfactory bond strength, can be attained.

In addition, there was nothing unusual as for the bonding interface, too.

Besides, although the assembly comprising two kinds of metal put one on the other was heated as it was and then subjected to elongating by means of a rotary mill or the assembly was subjected to a cold drawing and then heated followed by subjecting to the elongating in the rotary mill in the above description, an assembly comprising two kinds of metal and an intermediate layer put therebetween may be heated and then subjected to the elongating in the rotary mill.

(Fourth Example)

In this Example an outside layer member and a core member are joined together and restricted at one end of the assembly comprising the outside layer member and the core member by means of mechanical or metallurgical means not so as to relatively move and then at least the outside layer member is heated and the wall-thickness of the outside layer member is reduced from one end side of the assembly to bond the outside layer member on the core member.

The detailed description will be given below.

Figure 14:
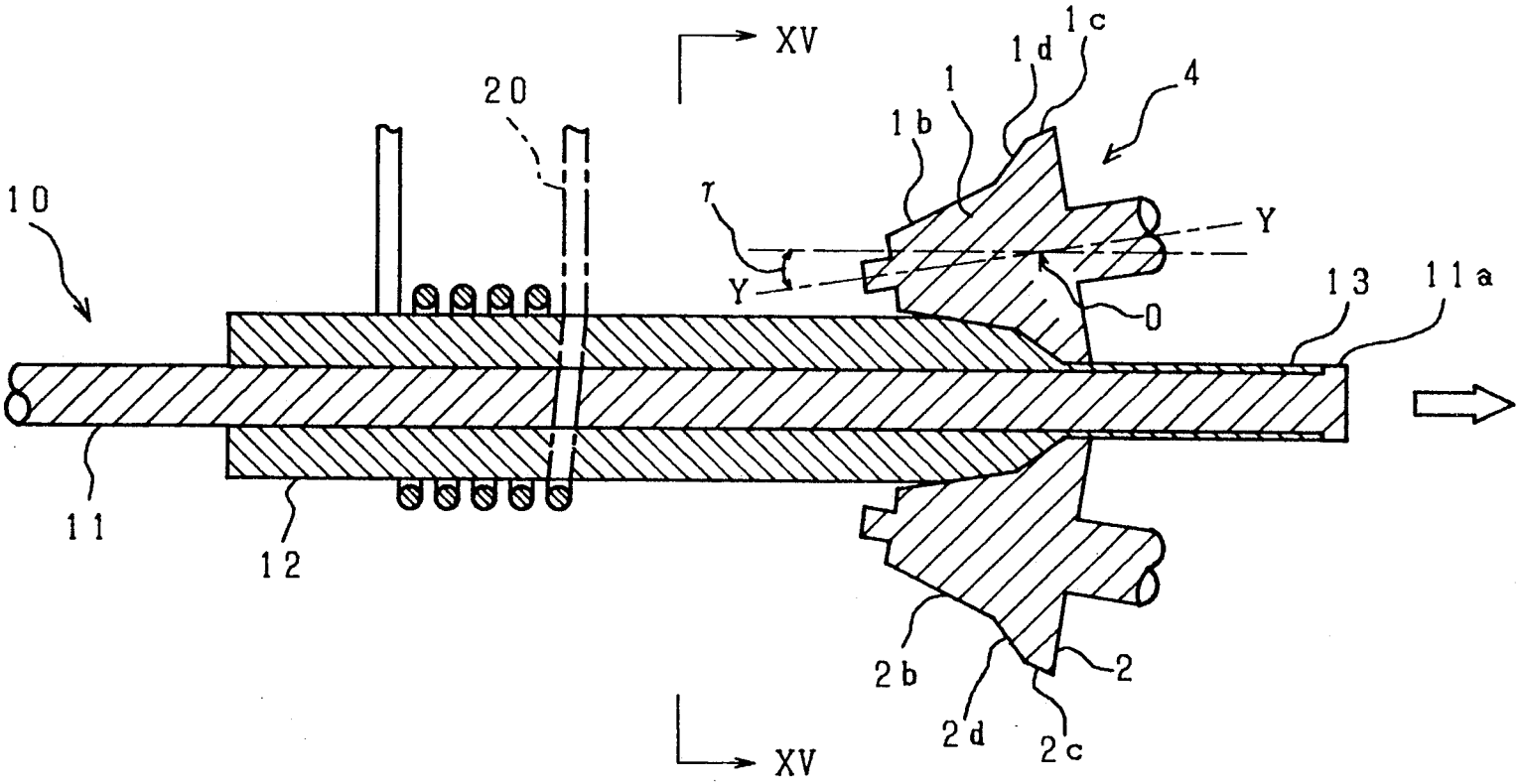
FIG. 14 is a schematic side sectional view of a rotary mill used in a method according to the present invention (taken along a line XIV—XIV of FIG. 15)
Figure 15:
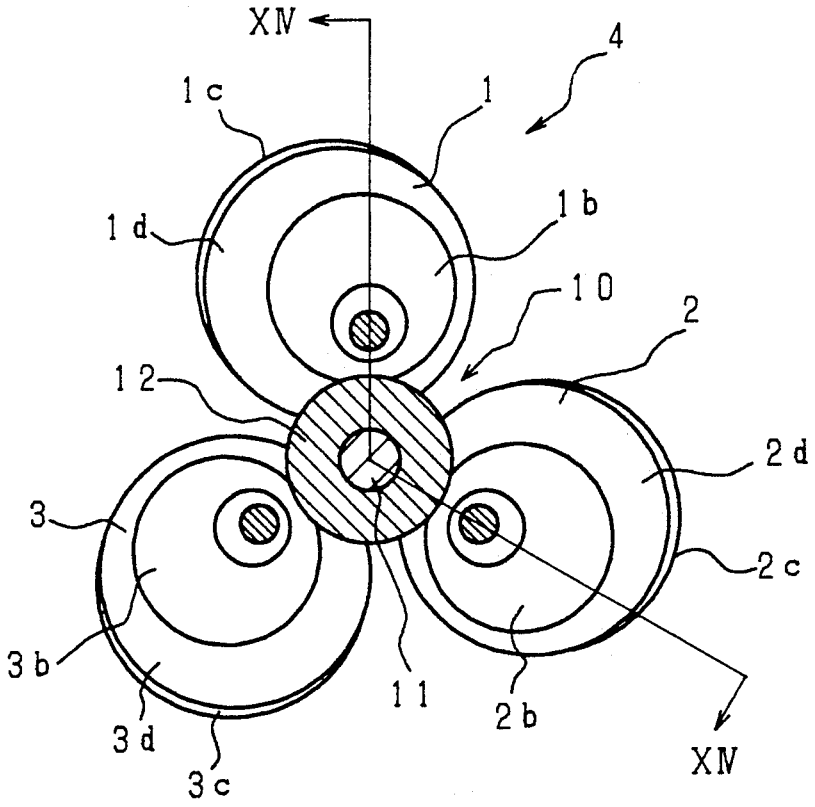
FIG. 15 is a front view of FIG. 14 taken along a line XV—XV thereof.

As shown in FIG. 14, an assembly 10 is a stepped columnar member and comprises a nearly columnar core member 11 provided with a skidproof restrictive member 11*a* having one end portion of slightly larger diameter and cylindrical outside layer member 12 having a length shorter than that of the core member 11 put on the core member 11 so as to be engaged with the restrictive member 11*a*, and heated by means of a high-frequency heating coil 20 and then transferred in a longitudinal direction (a direction shown by a white arrow) toward a rotary mill 4.

The rotary mill 4 is provided with three rolls 1, 2, 3 having a hump arranged around a pass line, said rolls 1, 2, 3 each having a diameter gradually increasing from an inlet side toward an outlet side, and with inlet faces 1*b*, 2*b*, 3*b* and the subsequent outlet faces 1*c*, 2*c*, 3*c* provided with hump portions 1*d*, 2*d*, 3*d* having a large face angle, outlet reeling portions and relief portions.

Figure 16:
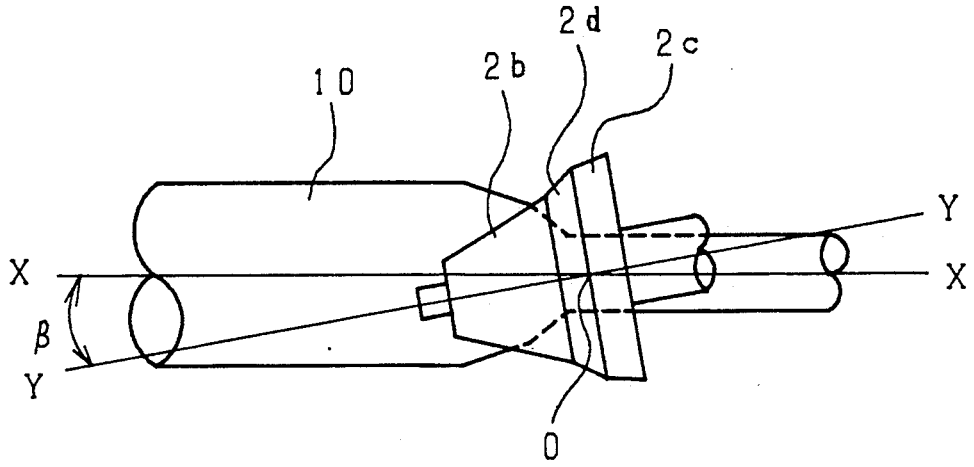
FIG. 16 is a side view showing a roll.

The rolls 1, 2, 3 have a cross angle $\gamma$ and a feed angle $\beta$ respectively, as shown in FIGS. 14, 16. The rolls 1, 2, 3 are connected with a driving device (not shown) and rotated in the same one direction, as shown by an arrow in FIG. 2. The hot assembly 10 rolled in among these rolls is transferred in a longitudinal direction with being rotated on the pass line, that is, it is forced to make a spiral progressive movement.

The assembly 10 is reduced in outside diameter of the outside layer member 12 by the inlet inclined portions **1*b*, 2*b*, 3*b* and the roll hump portions 1*d*, 2*d*, 3*d* at, for example, a maximum reduction in area of 80 to 90% while it is forced to make the spiral progressive movement among the rolls so that the outside layer member 12 may be formed in a stepped frustum conical shape, as shown in FIG. 14, and then turned into a clad bar 13 having an appointed outside diameter at the outlet faces 1*c*, 2*c*, 3*c***.

This Example will be below described in more detail.

The core member 11 is columnar and provided with the restrictive member **11*a* having a slightly larger diameter at one end portion thereof. The outside layer member 12 is cylindrical having an inside diameter equal to an outside diameter of the core member 11 or slightly larger than the outside diameter of the core member 11. An outside surface of the core member 11 and an inside surface of the outside layer member 12 are degreased and cleaned and then, the core member 11 is put in the inside of the outside layer member 12 so as to be engaged with the restrictive member 11*a* to obtain the assembly 10**.

The above described cleaning aims at the formation of a diffusion through the boundary surface between the core member 11 and the outside layer member 12 during the rolling. The interface must be maintained clean so that the diffusion may not be hindered even during the heating and rolling.

Subsequently, the assembly 10 is passed through the high-frequency heating coil 20. The frequency of the high-frequency heating coil 20 is set so as to heat merely the outside layer member 12 of the assembly 10. Accordingly, merely the outside layer member 12 is heated here and then the assembly 10 is rolled in among the rolls 1, 2, 3, whereby particularly the wall-thickness of the outside layer member is reduced. In this Example, since the rolls 1, 2, 3 having hump portion are used, the flaring can be prevented even though the deformation resistance of the outside layer member 12 is small. In addition, the outside layer member 12 receiving a reduction is prevented from sliding relatively to the core member by means of the restrictive member **11*a***, so that the outside layer member is elongated, whereby the core member is bonded with the outside layer member.

Thus, the core member 11 can be bonded with the outside layer member 12 all over the length thereof by suitably selecting a length of the core member 11, a length of the outside layer member 12 and a reduction in area of the outside layer member 12.

Besides, the diffusion layer formed between the core member 11 and the outside layer member 12 by heating is thinned by rolling. Further, the outside layer member 12 is elongated to cover a portion of the core member 11 which has been naked and portions of the outside layer member 12 elongated by the rolls 1, 2, 3 are diffused on the interface of the core member to form a thin diffusion layer, whereby bonding the outside layer member to the core member. Accordingly, the manufactured clad bar 13 exhibits a high bond strength all over the length thereof.

The concrete example will be described below.

Core member: pure Ti (JIS Grade 2) outside diameter: 20 mm, length: 2750 mm

Outside layer member: pure Al (JIS 1070) outside diameter: 32 mm, wall-thickness: 5.75 mm, length: 800 mm The core member and the outside layer member were degreased and cleaned and then the core member was fitted in the outside layer member to obtain an assembly. The outside layer member of the resulting assembly was heated at 500° C. and then subjected to the rolling by means of an Assel mill type rotary mill provided with rolls made of SCM440 under the conditions that a cross angle ($\gamma$): 5°, a feed angle ($\beta$): 10°, a maximum diameter of rolls in the hump: 120 mm, a face angle of an inlet inclined portion: 3°, a face angle of roll hump portion: 20°, and a rotational frequency of roll: 60 rpm to manufacture a clad bar having an outside diameter of 24 mm.

And, the manufactured clad bar was investigated on the bonding interface. It was found from the investigation results by an electron probe micro analysis (EPMA) that no oxide exists on the bonding interface. Furthermore, it was found from the investigation results by a scanning electron microscope (SEM) that no separation is found on the bonding interface and the diffusion layer is 1 micron thick. In addition, it was investigated whether separations are formed on the bonding interface obtained by cutting using a shearing machine or not, and no separation was found.

(Fifth Example)

This Example was carried out in the same manner as in Fourth Example.

Core member: pure Cu (JIS C 1100) outside diameter: 21.5 mm, length: 3100 mm outside layer member: pure Ti (JIS Grade 2) outside diameter: 32 mm, wall-thickness: 5 mm, length: 800 mm Both members of the assembly were simultaneously heated at 750° C. and then subjected to the rolling under the same conditions as in Fourth Example to manufactured a clad bar having an outside diameter of 21 mm. A reduction in area of the outside layer member and the core member was 78.3% and 16.3%, respectively.

The shear strength and bonding interface of the manufactured clad bar were investigated. The shear strength was 21.3 kgf/mm$^2$ which met the reference value of the shear strength of 10 kgf/mm$^2$ according to JIS G3604. In addition, on the bonding interface, no oxide was found as investigated by an EPMA and no separation was found as investigated by a SEM. The diffusion layer was 1.3 microns thick.

(Sixth Example)

This Example aims to increase the bond strength by carrying out the cold drawing prior to the rolling.

Figure 17:
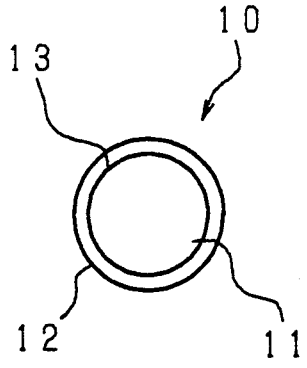
FIG. 17 is a sectional view showing an assembly used in a sixth preferred embodiment.
Figure 18:
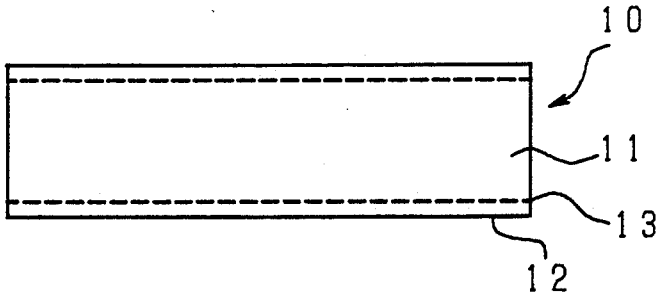
FIG. 18 is a side view of FIG. 17.

Referring to FIG. 17, which is a front sectional view showing an assembly 10, and FIG. 18, which is a side view showing the assembly 10, the assembly 10 comprises a core member 11 made of copper having a circular section, a Ni foil 13 wound around the periphery of the core member 11 and a cylindrical outside layer member 12 made of stainless steel put on the Ni foil 13 by drawing. The resulting round rod-like assembly 10 is heated in a heating furnace (not shown) and then transferred in a rotary mill.

Figure 19:
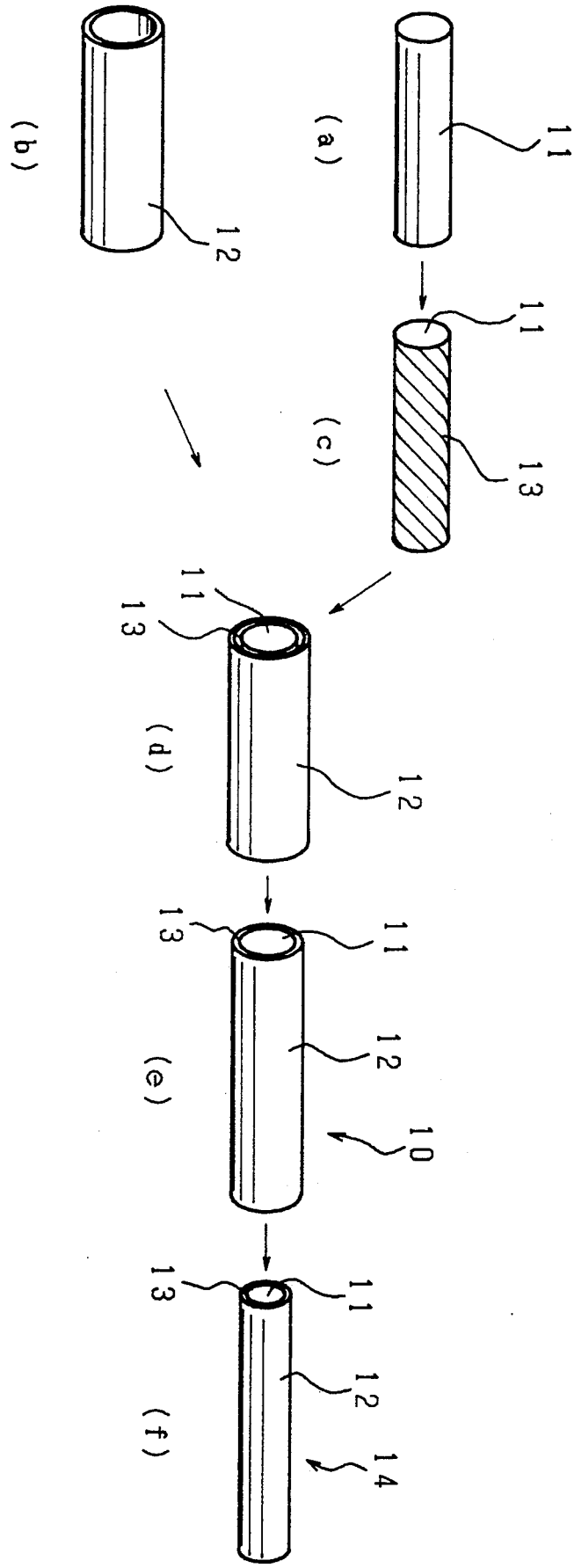
FIG. 19 is a progress chart of a sixth preferred embodiment.

FIG. 19 is a process chart showing this Example. At first, as shown in FIG. 19(*a*), a peripheral surface of a copper rod having a circular section is subjected to, for example, a turning to remove scale and then degreased and cleaned with acetone and the like to form the core member 11, while, as shown in FIG. 19(*b*), an inside circumferential surface a cylindrical stainless steel pipe is subjected to the pickling and then degreased and cleaned in the same manner as for the core member 11 to form the outside layer member 12.

The Ni foil 13 of, for example, about 40 microns thick is wound around the peripheral surface of said core member 11, as shown in FIG. 19(*c*), and the core member 11 surrounded by the Ni foil 13 is put in an inside of the outside layer member 12 and then subjected to the cold drawing, as shown in FIG. 19(*d*), to form the round rod-like assembly 10 as shown in FIG. 19(*e*).

It is a reason why said Ni foil 13 is wound that if copper is diffused into stainless steel, when the core member 11 and the outside layer member 12 are heated and rolled at high temperature with bringing into contact to each other, cracks are generated in stainless steel of the outside layer member. Accordingly, in this Example, easily diffusible Ni is put between both members so that copper may not be diffused into stainless steel, and is a diffusion layer is formed between the core member 11 and the Ni foil 13 as well as the outside layer member 12 and the Ni foil 13 to improve the bonding and the bond strength at the same time. In addition, Ni may be plated on the inside surface of the outside layer member 12 or the peripheral surface of the core member 11 in place of winding the Ni foil 13 around the core member 11.

Said assembly 10 is formed so that no gap may exist at the interface between the core member 11 and the Ni foil 13 as well as the outside layer member 12 and the Ni foil 13. In short, the assembly 10 is formed so that no oxide may be generated on the interface between the core member 11 and Ni foil 13 and the interface between the outside layer member 12 and the Ni foil 13 when heated.

Subsequently, the assembly 10 is heated at, for example, 1,020° C. in the heating furnace. This heating temperature is limited to temperature lower than 1,030° to 1,040° C. at which the lowest melting-point core member 11 begins to melt. Since stainless steel is apt to be broken at low temperature comparatively high temperature of 1,030° C. or less is preferably selected in view of the workability of stainless steel.

This heating leads to the formation of the diffusion layer on both interfaces during the rolling and the improvement in bonding and bond strength.

And, the heated assembly 10 is subjected to the rolling by said rotary mill. Thus, a stainless steel-clad copper bar 14 having high integrity of bonding and high bond strength as shown in FIG. 19(*f*) can be manufactured in a high productivity.

This Example is concretely described.

An inside surface and an outside surface of a stainless steel pipe (JIS SUS 310S) having an inside diameter of 66 mm and an outside diameter of 76.3 mm were subjected to the pickling and then degreased and cleaned with acetone. In addition, a copper rod (oxygen-free copper) was machined in a finishing accuracy of 1.6 microns Ra as prescribed in JIS B 0601 to make an outside diameter 62 mm and then degreased and cleaned with acetone. Subsequently, a Ni foil of 40 microns thick was wound around the periphery of the copper rod and the copper rod surrounded by the Ni foil was inserted into said stainless steel pipe. The resulting assembly was subjected to the cold drawing to reduce the outside diameter until 70 mm. The drawn assembly was heated at 1,020° C. and then subjected to the elongating until the outside diameter thereof becomes 60 mm, 50 mm, 40 mm and 35 mm. The rolling conditions were as follows:

A cross angle ($\gamma$): 5°, a feed angle ($\beta$): 13°, a diameter of roll: 180 mm, a material of roll: SCM440, and a rotational frequency of roll: 100 rpm.

The results of the measurement of shear strength by the method shown in FIG. 9 are shown in the following Table.

| Outside diameter after rolling | Reduction in area | Shear strength (kgf/mm$^2$) |
|---|---|---|
| 60 | 26.5% | 19.2, 19.5 |
| 50 | 49.0% | 20.1, 19.8 |
| 40 | 67.3% | 20.5, 21.1 |
| 35 | 75.0% | 21.4, 22.2 |

In every case, the shear strength of 10 kgf/mm$^2$ or more can be attained.

Figure 20:
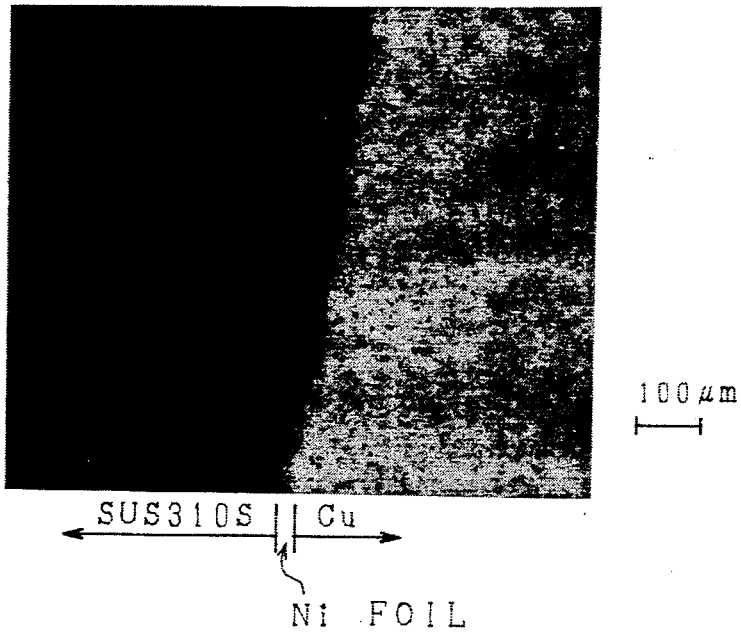
FIG. 20 is a SEM photograph showing a bonding interface between a core member and an outer layer member.
Figure 21:
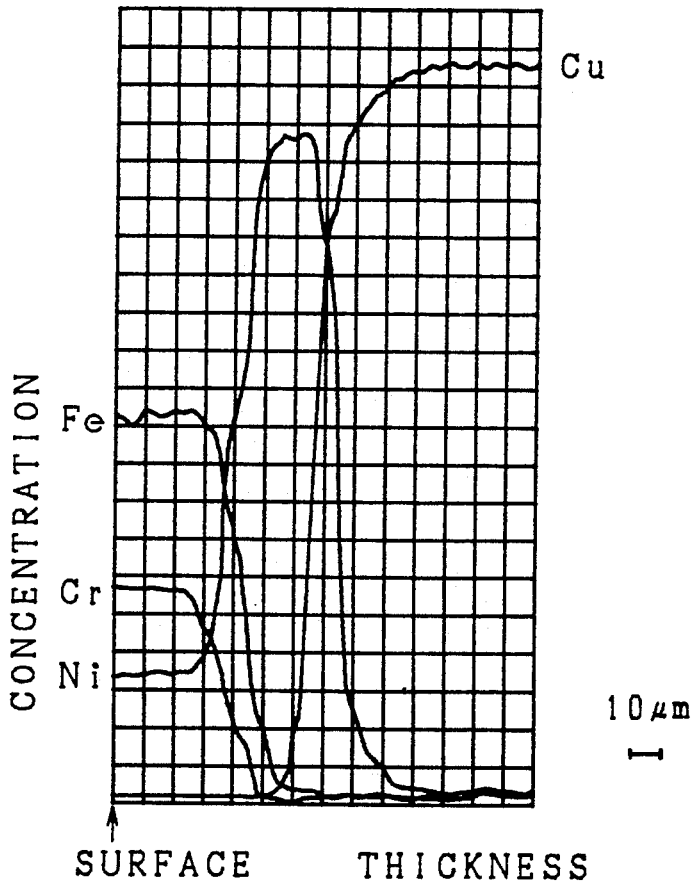
FIG. 21 is a graph showing an EPMA (electron probe micro analysis) results.

In addition, in order to investigate the bonding interface of said clad bar, the observation by a scanning electron microscope (SEM), the observation by an electron probe micro analysis (EPMA) and the ultrasonic test were carried out. Then, no separation and oxide were confirmed, as shown in FIG. 20, from the observation by a SEM. In addition, the concentration of Ni, Cr, Fe and Cu to be measured was changed in the direction of thickness in the vicinity of both interfaces, as shown in FIG. 21, according to the observation by an EPMA. It can be understood from the above observation that each element is sufficiently diffused and an excellent bond is attained. Besides, it was found from the results of the ultrasonic test that no defect, such as the generation of cracks, existed on the interface.

(Seventh Example)

In this Example the assembly is subjected to cold drawing in the same manner as in Sixth Example and then both end faces of the assembly are tightly closed up by fusion welding. In the event that the thermal expansion coefficient of an outside layer member is larger than that of a core member, clearance is generated between the core member and the outside layer member and the interface is oxidized according to circumstances but the oxidation can be prevented by tightly closing up both end faces of the assembly, whereby attaining a high bond strength.

Core member: carbon steel (C: 0.06%)

Outside layer member:stainless steel (JIS SUS304)

| | | |
|---|---|---|
| Size <1> | Core member diameter: 55 mm | Outside layer member outside diameter: 60.5 mm wall-thickness: 1.65 mm |
| <2> | Core member diameter: 47 mm | Outside layer member outside diameter: 60.5 mm wall-thickness: 5.5 mm |

The core member was subjected to the polishing process and then degreased and cleaned.

An inside circumferential surface of the outside layer member was degreased and cleaned and then the core member was inserted into the outside layer member.

Subsequently, the resulting assembly was subjected to the cold drawing to make an outside diameter 57 mm.

Subsequently, the core member and the outside layer member are welded together at both end faces of the assembly by the shield metal arc welding to close up the interface between the core member and the outside layer member tightly. Then, the assembly is heated at 1,100° C. and subjected to the elongating by the rotary mill.

Rolling conditions were selected as follows:
cross angle ($\gamma$): 3°
feed angle ($\beta$): 15°
rotational frequency of roll: 100 rpm
reduction in area: 79.2% (57 mmϕ→26 mmϕ)

The shear strength was measured by a method as shown in FIG. 9 with the results as shown below.

<1> 34.4 kgf/mm$^2$, <2> 35.2 kgf/mm$^2$

In addition, a thickness of the outside layer member was measured at 8 points in a circumferential direction with the results as shown in the following Table. As obvious from these results, a nearly uniform distribution of wallthickness was attained. In addition, an outside diameter was 26±0.02 mm in both cases <1> and <2>.

| Sample | Wall-thickness distribution | Average value |
|---|---|---|
| <1> | 0.72, 0.70, 0.69, 0.71, 0.68, 0.70, 0.70, 0.71 | 0.70 |
| <2> | 2.47, 2.49, 2.53, 2.51, 2.53, 2.51, 2.47, 2.49 | 2.50 |

In addition, it was found from the investigation by the ultrasonic test that no separation existed on the interface.

(Eight Example)

This Example is characterized by a method of tightly closing up both end faces of the assembly.

Core member: pure Ti (JIS Grade 2) outside diameter: 54.6 mm, length: 800 mm

Figure 22:
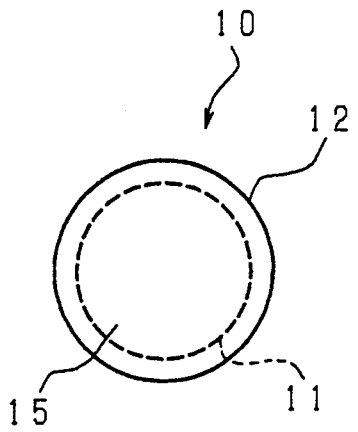
FIG. 22 is an end view showing an assembly used in an eighth preferred embodiment.
Figure 23:
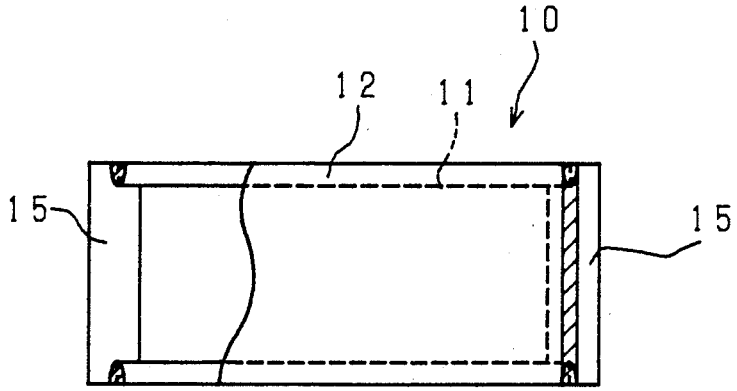
FIG. 23 is a side sectional view showing an assembly used in an eighth preferred embodiment.

Outside layer member: pure Ni (Ni: 99.6%) outside diameter: 60.3 mm, wall-thickness: 2.8 mm, and length: 806 mm FIG. 22 is a front view showing an assembly 10, and FIG. 23 is a side view showing the assembly 10.

An inside circumferential surface of the outside layer member and a peripheral surface of the core member are degreased and cleaned, and then the core member is fitted in the outside layer member to form an assembly. The resulting assembly is provided with a disc-like cap 15 made of Ni engaged with both end faces thereof by means of suitable means and the cap 15 is welded to the outside layer member 12 by the electron beam welding method under vacuum or under reduced pressures. The cap 15 is used because Ti can not be welded to Ni.

The degree of vacuum was selected at $5\times10^{-1}$, $1\times10^{-1}3\times10^{-2}$, $3\times10^{-3}$ and $3\times10^{-4}$ Torr, respectively.

After tightly closing up the assembly, the assembly was heated at 800° C. and then subjected to elongating by the rotary mill.

The rolling conditions were selected as follows:
cross angle ($\gamma$): 3°
feed angle ($\beta$): 13°
diameter of roll: 117 mm
rotational frequency of roll: 80 rpm
reduction in area: 88.5% (60.3 mmϕ→20.5 mmϕ)

Figure 24:
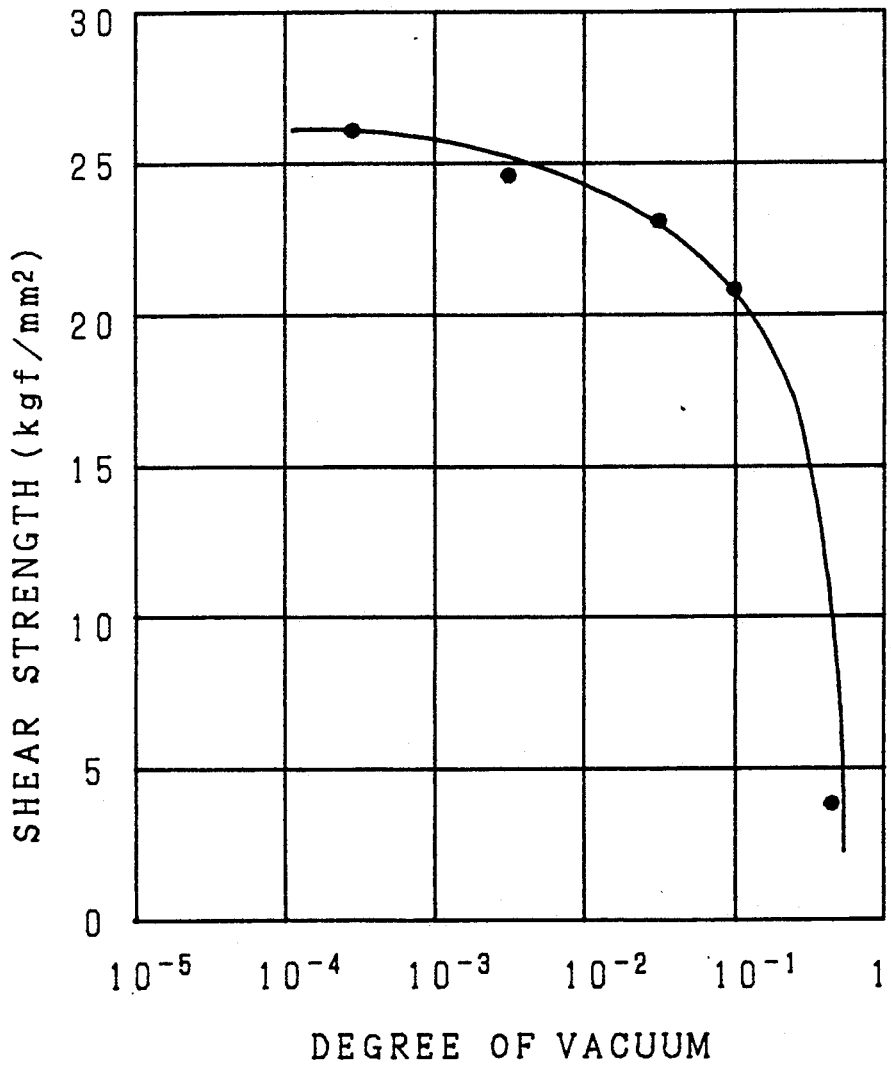
FIG. 24 is a graph showing a shear strength in an eighth preferred embodiment.

The shear strength of the resulting clad bar was measured by the method as shown in FIG. 9 with the results shown in FIG. 24. In the event that the degree of vacuum is $1\times10^{-1}$ Torr or more, the shear strength is remarkably reduced. Accordingly, the degree of vacuum of preferably $1\times10^{-1}$ Torr or less should be selected in the welding. If the degree of vacuum of $1\times10^{-1}$ Torr or less is used, the shear strength of the resulting clad bar can meet the reference value of the shear strength of titanium-clad steel of 14 kgf/mm$^2$ prescribed in JIS G3603.

Figure 25:
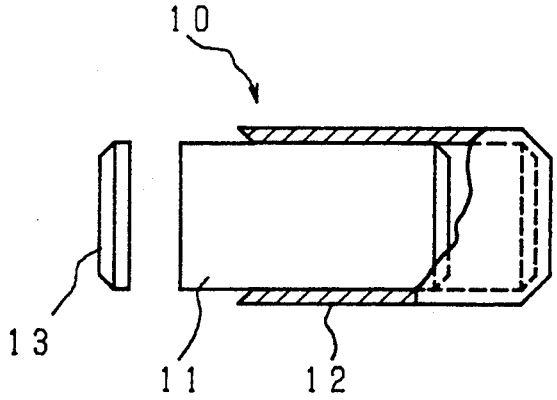
FIG. 25 is a side sectional view showing an assembly in another preferred embodiment.

In addition, the outside layer member 12 may be formed in a cylinder having a bottom, as shown in FIG. 25, and the core member 11 is inserted into the outside layer member 12, and then an opened portion of the cylinder may be covered with the cap 13 followed by welding in vacuum chamber by the electron beam welding method.

(Ninth Example)

In this Example, the same method as in Eighth Example is used.

The size of the core member and the outside layer member is same as in Eighth Example.

The materials are shown in the following Table. The degree of vacuum was selected at $3\times10^{-3}$ Torr. The shear strength is shown in the following Table as measured by the method shown in FIG. 9. That is, the shear strength is 20 kgf/mm$^2$ or more in every sample.

| Sample | Core member | Outside layer member | Shear strength (kgf/mm$^2$) |
|---|---|---|---|
| 1 | pure Ti | pure Ni | 22.5 |
| 2 | " | Ni—10Cr—2Cu | 23.0 |
| 3 | " | Ni—1Cr—4Cu | 21.3 |
| 4 | " | Ni—20Cr—3Cu | 24.5 |
| 5 | Ti—6Al—4V | Ni—10Cr—2Cu | 21.8 |

pure Ti (JIS Grade 2), pure Ni (Ni: 99.6%)

Figure 26:
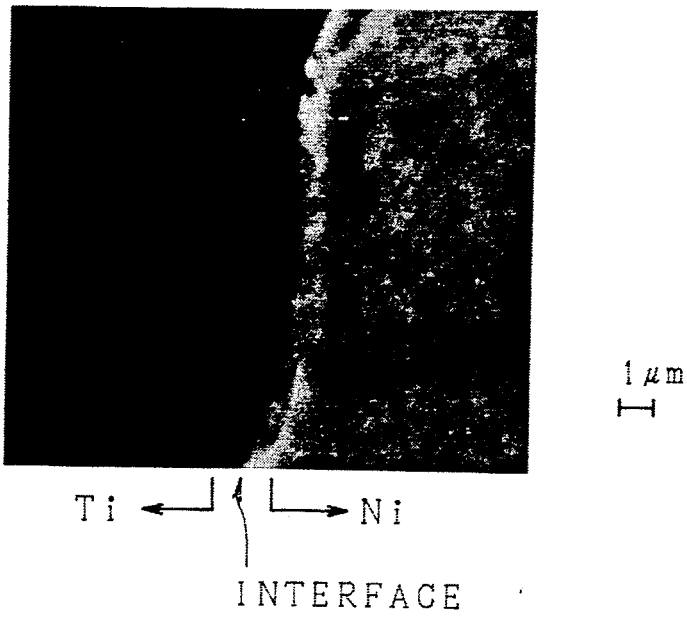
FIG. 26 is a SEM photograph showing a bonding interface in a ninth preferred embodiment.

A clad bar, which is obtained in the above described manner, was cold drawn by means of a die until a outside diameter of 3 mm. FIG. 26 is a photograph of the final clad wire taken by a SEM. No separation and oxide were observed at all. In addition, it is necessary to remove scales from the outside surface prior to the cold drawing.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A method of manufacturing a clad bar, in which a columnar core member is fitted in a cylindrical outside layer member having a greater resistance to deformation than the columnar core member to bond them to each other, comprising:

heating an assembly obtained by fitting the core member in the outside layer member; and elongating the heated assembly by a rotary mill having three or more cone type rolls to finish the assembly to a desired size with the interface between the core member and the outside layer member being characterized by diffusion bonding.

2. A method of manufacturing a clad bar as set forth in claim 1, in which the heating temperature is selected at temperature lower than melting points of the core member, the outside layer member and intermetallic compounds thereof.

3. A method of manufacturing a clad bar as set forth in claim 1, in which said rotary mill is provided with rolls having a structure supported at both ends, a cross angle being set at 0°-15°, and a feed angle being set at 6°-20°.

4. A method of manufacturing a clad bar as set forth in claim 1, in which a reduction rate in said elongating is selected at 25% or more/pass.

5. A method of manufacturing a clad bar as set forth in claim 1, in which a thermal expansion coefficient of the outside layer member is smaller than that of the core member.

6. A method of manufacturing a clad bar as set forth in claim 1, in which the outside layer member is fixedly mounted on the core member at one end thereof prior to the elongating.

7. A method of manufacturing a clad bar as set forth in claim 6, in which the core member is longer than the outside layer member, the assembly comprising the core member and the outside layer member being trued up and fixed at one end prior to the elongating, and the assembly being introduced into the rotary mill from said one end side, said rotary mill having three or more cone type rolls having a hump portion.

8. A method of manufacturing a clad bar as set forth in claim 7, in which the outside layer member is preferentially heated to make the deformation resistance thereof smaller than that of the core member and then the assembly is introduced into the rotary mill.

9. A method of manufacturing a clad bar, in which a columnar core member is fitted in a cylindrical outside layer member having a greater resistance to deformation than the columnar core member to bond them to each other, comprising:

tightly closing up a gap at each end of the assembly comprising the core member and the outside layer member under reduced pressure or under vacuum;

heating the closed up assembly; and elongating the heated assembly by a rotary mill having three or more cone type rolls to finish the assembly to a desired size with the interface between the core member and the outside layer member being characterized by diffusion bonding.

10. A method of manufacturing a clad bar as set forth in claim 9, in which the heating temperature is selected at temperature lower than melting points of the core member, the outside layer member and intermetallic compounds thereof.

11. A method of manufacturing a clad bar as set forth in claim 9, in which said rotary mill is provided with rolls having a structure supported at both ends, a cross angle being set at 0°-15°, and a feed angle being set at 6°-20°.

12. A method of manufacturing a clad bar as set forth in claim 9, in which a reduction rate in said elongating is selected at 25% or more/pass.

13. A method of manufacturing a clad bar as set forth in claim 9, in which a thermal expansion coefficient of the outside layer member is larger than that of the core member.

14. A method of manufacturing a clad bar as set forth in claim 9, in which said closing up of said gaps is carried out by the electron beam welding method.

15. A method of manufacturing a clad bar as set forth in claim 9, in which a gap is sealed by welding a putting plate to end faces of the assembly comprising the core member and the outside layer member.

16. A method of manufacturing a clad bar as set forth in claim 15, in which said core member is made of titanium or titanium alloys and the outside layer member is made of nickel or nickel alloys.

17. A method of manufacturing a clad bar, in which a columnar core member is fitted in a cylindrical outside layer member having a greater resistance to deformation than the columnar core member to bond them to each other, comprising:

cold drawing an assembly comprising the core member and the outside layer member;

heating the cold drawn assembly; and elongating the heated assembly by a rotary mill provided with three or more cone type rolls to finish the assembly to a desired size with the interface between the core member and the outside layer member being characterized by diffusion bonding.

18. A method of manufacturing a clad bar as set forth in claim 17, in which said core member is made of copper and the outside layer member is made of stainless steel.

19. A method of manufacturing a clad bar as set forth in claim 17, in which nickel is interposed between the core member and the outside layer member.

20. A method of manufacturing a clad bar as set forth in claim 17, in which the heating temperature is selected at temperature lower than melting points of the core member, the outside layer member and intermetallic compounds thereof.

21. A method of manufacturing a clad bar as set forth in claim 17, in which said rotary mill is provided with rolls having a structure supported at both ends, a cross angle being set at 0°-15°, and a feed angle being set at 6°-20°.

22. A method of manufacturing a clad bar as set forth in claim 17, in which a reduction rate in said elongating is selected at 25% or more/pass.

23. A method of manufacturing a clad bar as set forth in claim 17, in which a thermal expansion coefficient of the outside layer member is smaller than that of the core member.

24. A method of manufacturing a clad bar, in which a columnar core member is fitted in a cylindrical outside layer member to bond them to each other, the deformation resistance of the outer layer member being greater than that of the core member, comprising:

cold drawing an assembly comprising the core member and the outside layer member;

sealing the cold drawn assembly at each end thereof;

heating the tightly closed assembly; and elongating the heated assembly by a rotary mill provided with three or more cone type rolls with the interface between the core member and the outside layer member being characterized by diffusion bonding.

25. A method of manufacturing a clad bar as set forth in claim 24, in which said core member is made of carbon steel or low-alloy steel and the outside layer member is made of stainless steel.

26. A method of manufacturing a clad bar as set forth in claim 24, in which heating temperature is selected at temperature lower than melting points of the core member, the outside layer member and intermetallic compounds thereof.

27. A method of manufacturing a clad bar as set forth in claim 24, in which said rotary mill is provided with rolls having a structure supported at both ends, a cross angle being set at 0°–15°, and a feed angle being set at 6°–20°.

28. A method of manufacturing a clad bar as set forth in claim 24, in which a reduction rate in said elongating is selected at 25% or more/pass.

29. A method of manufacturing a clad bar as set forth in claim 24, in which a deformation resistance of the outside layer member is larger than that of the core member.

30. A method of manufacturing a clad bar as set forth in claim 24, in which a thermal expansion coefficient of the outside layer member is larger than that of the core member.

* * * * *